United States Patent [19]

Bührer, deceased et al.

[11] 4,357,984

[45] Nov. 9, 1982

[54] METHOD AND APPARATUS FOR PRODUCING A FOUNDRY MOLD

[75] Inventors: Erwin Bührer, deceased, late of Schaffhausen, Switzerland, by Dora B. Bührer, heir; by Grete Brändli, heir, Samstagern; by Lotte Roth, heir, Effretikon, both of Switzerland; by Doris Baumann, heir, London, England

[73] Assignee: Georg Fischer Aktiengesellschaft, Switzerland

[21] Appl. No.: 202,749

[22] Filed: Oct. 31, 1980

[30] Foreign Application Priority Data

Nov. 1, 1979 [CH] Switzerland ..... 9797/79

[51] Int. Cl.[3] ..... B22C 15/00

[52] U.S. Cl. ..... 164/37; 164/193

[58] Field of Search ..... 164/192–194, 164/37–40

[56] References Cited

U.S. PATENT DOCUMENTS 3,601,161 8/1971 Buhrer ..... 164/193 X

FOREIGN PATENT DOCUMENTS 728015 4/1955 United Kingdom ..... 164/193

*Primary Examiner*—Gus T. Hampilos
*Assistant Examiner*—K. Y. Lin
*Attorney, Agent, or Firm*—Roylance, Abrams, Berdo & Farley

[57] ABSTRACT

A mold filling and compacting method includes forming a compact body of mold substance such as sand in an intermediate container and then abruptly opening the bottom closure of the container while releasing the sand, as a compact mass, so that it drops as a packet into the mold box, compacting itself effectively around a pattern arrangement. Specific techniques for releasing, including sudden lifting, sudden dropping and separating the container parts are disclosed as well as apparatus for performing the method.

13 Claims, 12 Drawing Figures

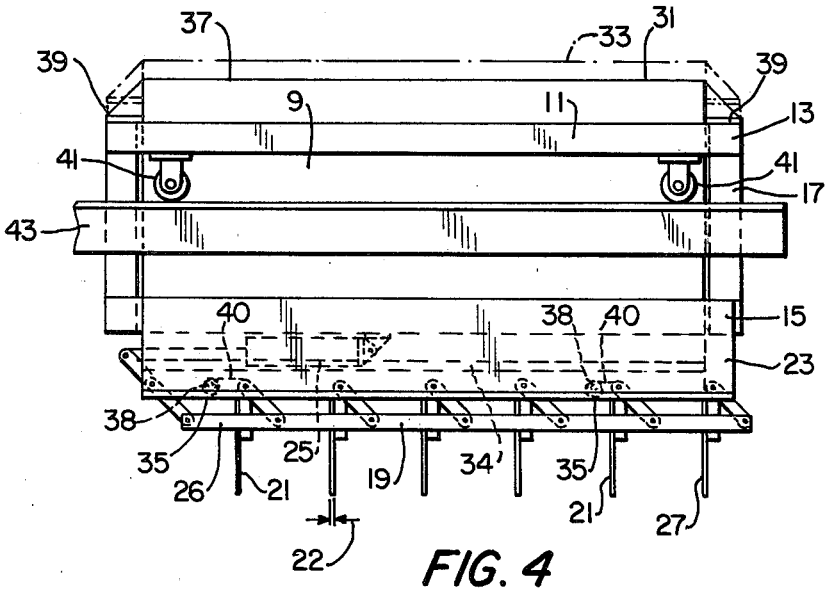
FIG. 4
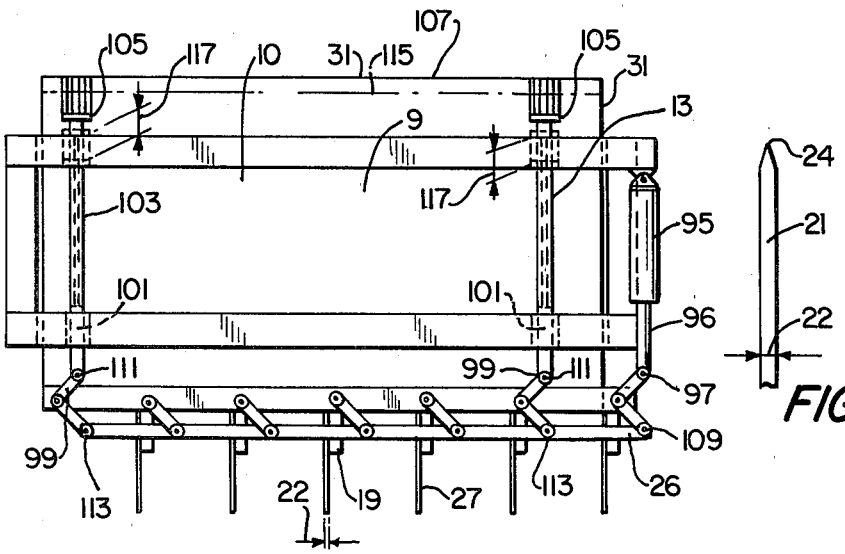
FIG. 4a
FIG. 4b

METHOD AND APPARATUS FOR PRODUCING A FOUNDRY MOLD

This invention relates to a process and apparatus for the production of a foundry mold wherein a molding box is disposed on a pattern plate and molding sand is discharged into the molding box from an intermediate container having a bottom closure.

BACKGROUND OF THE INVENTION

In Swiss Pat. No. 462,392, a process is disclosed for dosing two varieties of molding sand into a molding box of a foundry mold using two sand hoppers or silos with assigned delivery mechanisms and an intermediate container disposed below the silos, the bottom of the intermediate container being formed by a louver closure. The molding box is filled by opening the louver closure of the intermediate container after the container has been placed over the molding box.

This process has the disadvantage that the molding sand is poured into the molding box practically uncompacted and, therefore, when a high quality mold is to be produced, it is necessary to employ two compacting operations, for example, a first operation involving shaking and a subsequent operation by pressing, or using vibration pressing.

From the Journal "Litjnoe Proizvodstvo in Deutsch," issue of 1962, pages 38 and 39, an experiment for compact molding by gravity and pressing is known. A mold having lateral dimensions of 600×700 millimeters and 250 millimeters in height was filled with a sand filling of 500 millimeters height from a doser the bottom of which is closed by a slide. The slide of the doser was opened quickly for the filling. The experiment resulted in the strongest compaction in the lower layers of the sand filling and no compaction in the upper layers. In the further course of the experiment, a smaller compaction was found to exist along the walls of the molding box and dropped even more in the corners of the molding box. No experiments with larger molds have been known. Such experiments would have shown even worse results because of the longer time needed for opening the doser slides. These results show that the process employed in the experiment is not suitable to avoid the known insufficiencies occurring during compacting of a sand mold by a precompacting taking place during filling.

BRIEF DESCRIPTION OF THE INVENTION

An object of the present invention is to avoid the above mentioned disadvantages and to bring about a uniform and great compacting of the sand filling in the molding box by an optimal use of the potential energy of the sand in an intermediate container. This process will also make possible the production of larger molds.

Briefly described, the invention includes a process for producing a foundry mold comprising the steps of providing a molding box on a pattern plate for receiving molding sand, providing an intermediate container to receive molding sand from a supply thereof, the intermediate container having an openable bottom closure, locating the intermediate container above the molding box, and abruptly opening the bottom closure of the intermediate container and suddenly releasing the body of sand contained therein so that the body of sand falls as a packet and is deposited in the molding box.

In another aspect, the invention includes an improved apparatus for producing a foundry mold of the type having a pattern on a pattern plate and a molding box for receiving molding sand around the pattern, the apparatus comprising means for loading compact sand into the molding box including a molding sand silo, an intermediate container locatable below the silo and having an openable bottom closure, and drive means for opening and closing the closure, the improvement wherein said intermediate container includes a frame movable independently of said bottom closure, and means for abruptly changing the elevation of said intermediate container during opening of said bottom closure.

As will be recognized, the foregoing and other objects are achieved according to the invention because of the fact that the molding substance is suddenly released as a packet by the intermediate container during opening of the bottom closure. As a result of that, the time during which the impact force of the freely falling filling sand acts on the pattern or the pattern plate is considerably shortened, resulting in a considerable increase of the volume flow with the consequence that the compacting in the molding box takes place under the action of a thrust force. Experiments have shown that a uniform and great compacting of the filling sand in the molding box is achieved using the method and apparatus described herein.

By precompacting the sand in the intermediate container, before discharge into the molding box, one can achieve a packet of molding substance in the container which is more compact and more resistant to breaking apart. This can be accomplished, for example, by means of a centrifugal roller or, alternatively, one can use arrangement such as that shown in Swiss Pat. No. 301,031, wherein a precompressing is brought about by a high column of molding sand.

Furthermore, the sudden release of the molding sand from the intermediate container will be achieved in accordance with the invention through the fact that the intermediate container, during opening of the bottom closure, either drops onto locally fixed stops or is lifted suddenly out of its rest position, or through the fact that the intermediate container, in a multipart container embodiment, is drawn suddenly away from the molding sand.

When the inside dimensions of the frame of the intermediate container are chosen smaller than the inside dimensions of the molding box, the compacting of the sand filling the molding box is compensated and increased. A subdivision of the intermediate container into several part-containers permits the production of large molds.

In order that the manner in which the foregoing and other objects are attained in accordance with the invention can be understood in detail, particularly advantageous embodiments thereof will be described with reference to the accompanying drawings, which form a part of this specification, and wherein:

FIG. 4 is an enlarged side elevation of a portion of the apparatus of FIGS. 1–3 in the direction of arrow B of FIG. 3;

FIG. 4*a* is a side elevation of further embodiment of an apparatus in accordance with the invention;

FIG. 4*b* is an enlarged view of a lamellae of the bottom closure of the apparatus of FIGS. 1–4 or 4*a;*

Figure 5:
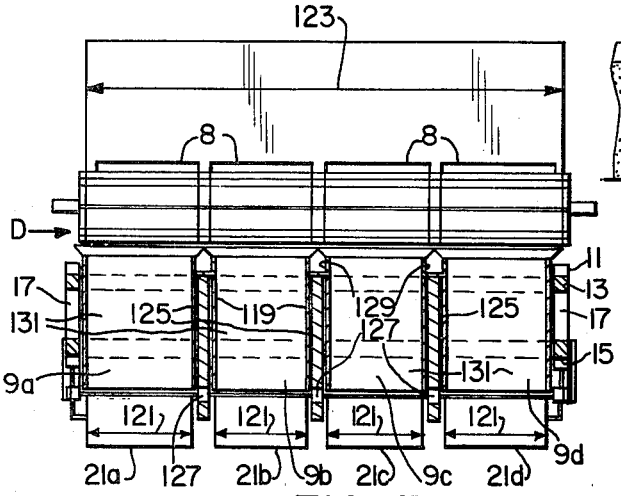
Figure 6:
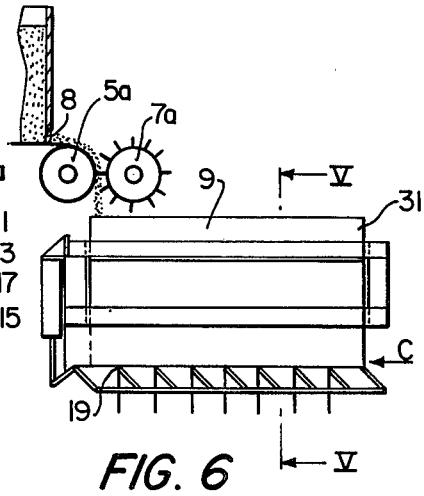
Figure 7:
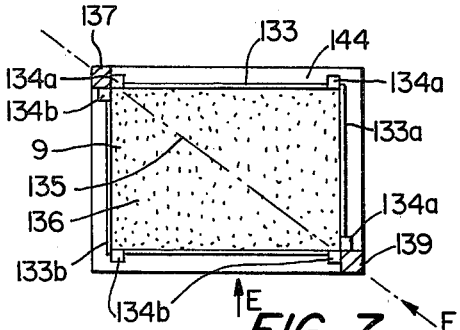
Figure 8:
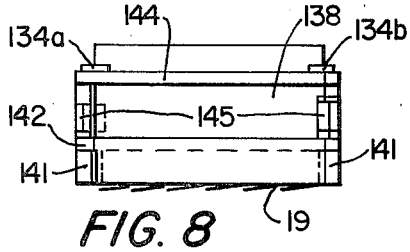
Figure 9:
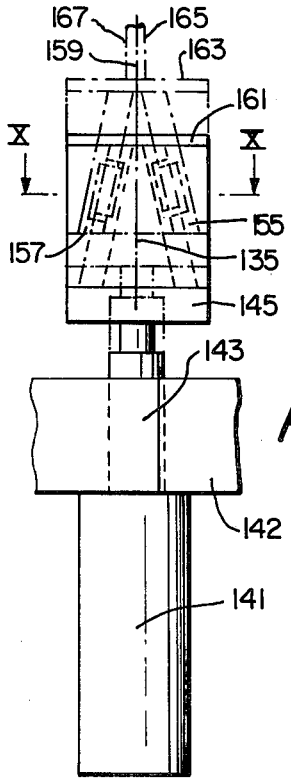
Figure 10:
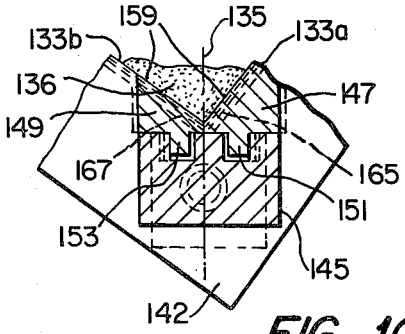

FIG. 5 is an end elevation of a further embodiment of an apparatus in accordance with the invention in partial section along line V—V of FIG. 6;

FIG. 6 is a side elevation of the apparatus of FIG. 5, viewed in the direction of arrow D;

FIG. 7 is a plane view of a further embodiment of an intermediate container in accordance with the invention;

FIG. 8 is a side elevation of the apparatus of FIG. 7 in the direction of arrow E;

FIG. 9 is an enlarged corner elevation of a portion of the apparatus of FIG. 7, viewed in the direction of arrow F; and FIG. 10 is an enlarged partial plane view along line X—X of FIG. 9.

Figure 1:
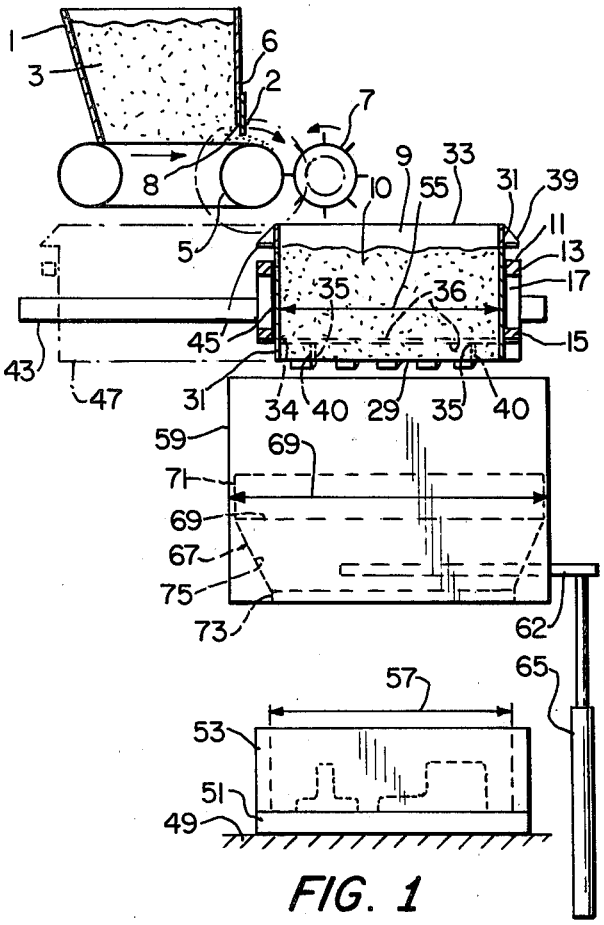
FIG. 1 is a side elevation of an apparatus in accordance with the invention, partly in section.

The apparatus of FIG. 1 includes a hopper or silo 1 which is a supply hopper filled with molding substance such as molding sand 3, the bottom of the silo being provided with a delivery mechanism 5 which cooperates with a centrifugal roll 7 during the delivery of the sand. An intermediate container 9, which has a bottom closure 19 and a frame 31 disposed above the bottom closure (see also FIGS. 2–4), is supported in a carrier structure 11 which includes two frames 13 and 15 as well as vertical support members 17. The bottom closure 19 of intermediate container 9 includes a plurality of plates or lamellae 21 which are journaled in side plates 23 attached to frame 15, the lamellae being rotatably or pivotably journaled and coupled together so that they can be simultaneously operated by piston and cylinder assemblies 25 (FIGS. 3 and 4). The intermediate container 9 and the delivery mechanism 5 are relatively movable, in horizontal directions, if desired so that the intermediate container can be filled with a desired quantity of molding sand and, if necessary, moved to a position over a molding box.

Figure 2:
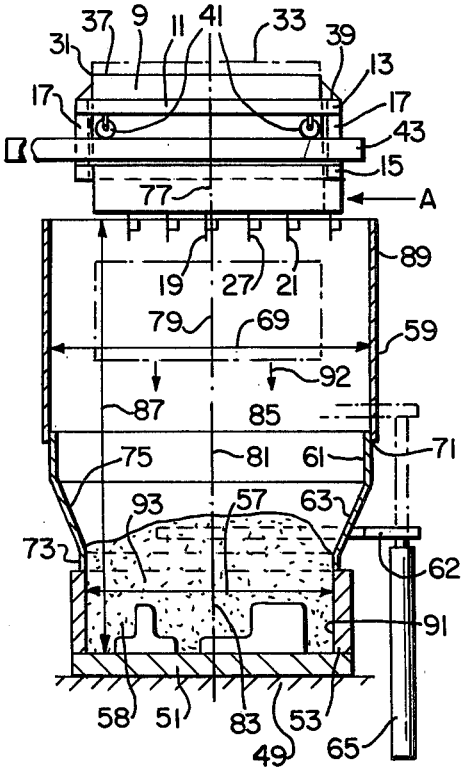
FIG. 2 is a side elevation of the apparatus of FIG. 1, partially in section, with the intermediate container thereof emptied.
Figure 3:
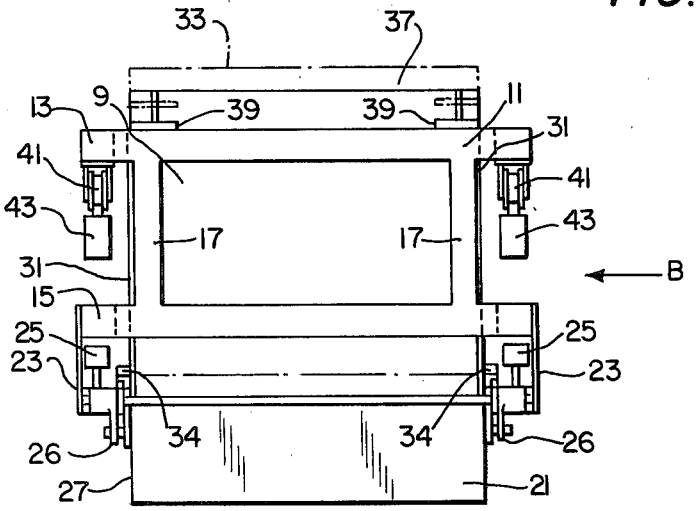
FIG. 3 is an end elevation, in the direction of arrow A of FIG. 2.

As seen in FIGS. 2–4, the bottom closure 19 is in an open position 27 and in FIG. 1 the closure is shown in a closed position 29. Preferably, the frame 31 is tapered or widened conically or pyramidally downwards since the filling sand 10 can then be separated most quickly from the walls of the intermediate container 9. The intermediate container is vertically movable relative to the carrier frame construction 11 and, in the elevated position 33, the intermediate container is suported by four rollers 35 which are rotatably mounted on pivotable links 40, the rollers being movable with the links 40 so that they act upwardly against longitudinally extending flanges or strips 34 fixedly attached to the outer side surfaces of the intermediate container 9. Links 40, as shown in FIG. 4, are coupled to the parallelogram linkage system forming part of bottom closure assembly 19.

In the lowered position, laterally protruding flanges on the frame 31 of the intermediate container rest on and are supported by outwardly extending brackets 39 on the upper frame 13 forming part of the vertically fixed carrier structure 11. The carrier structure 11 with the intermediate container 9 is supported on rollers 41 which ride on guide rails 43 so that, when the bottom closure 19 is closed, that assembly can be moved horizontally back and forth between the position 45 shown in solid lines and position 47 shown in phantom lines in FIG. 1.

A pattern arrangement 51, on which a molding box 53 is placed, is supported on a support surface 49. The inside dimensions 55 of the frame 31 of the intermediate container 9 are preferably chosen to be smaller than the inside dimensions 57 of the molding box 53. In this connection, it should be noted that dimensions 55 and 57 are intended to represent both, or all, relevant lateral dimensions of the frame and box . A vertically movable sleeve 61 can be lifted from a lowered position 63 by a piston and cylinder assembly 65 into a position 67 and is guided in that motion within a locally fixed sleeve 59. The lateral dimensions 69 of the sleeve 59 are chosen to be larger than the lateral dimensions 57 of the molding box 53. The movable sleeve 61 is guided in the fixed sleeve 59 by its upper part 71, while its lower part 73 is adapted to the dimensions 57 of the box and the two portions are coupled together by a conical or pyramidal middle part 75. The centers of gravity 77, 79, 81 and 83 of the cross sectional areas of the intermediate container 9, of the sleeves 59 and 61, and of the molding box 53 are disposed along one common vertical line 85 as illustrated in FIG. 2. Advantageously, adjustable guide plates can be inserted in the sleeve 61 to control the distribution of the sand in the molding box.

Following is a discussion of the method of operation of the embodiment illustrated in FIGS. 1–4.

FIG. 1 shows the intermediate container 9 with its bottom closure 19 is closed position 29, and with the filling sand 10 in the position 45 above the pattern arrangement 51. The pattern arrangement 51 with the molding box 53 placed thereon, enclosing the volume into which molding sand will be deposited, is supported on surface 49. Sleeve 61 rests on bracket 62 of piston and cylinder assembly 65 in the elevated position 67. By operating the cylinder 65, bracket 62 with sleeve 61 is lowered into position 63 illustrated in FIG. 2, and at the same time it forms, with sleeve 59, a guide conduit above the molding box 53 and over the pattern arrangement 51 which extends upwardly to intermediate container 9. By operating piston and cylinder assemblies 25, bottom closure 19 is moved from the closed position 29 into the open position 27 through the rod linkage system 26. At the same time, rollers 35 are moved from the position 36 into the position 38 and, in so moving, they lower frame 31 of the intermediate container from the position 33 into lowered position 37 in which the frame is stopped suddenly when the bracket 39 abuts the frame 13 of the carrier structure 11. As a result of the abrupt interruption of the dropping movement of frame 31, the body of filling sand 10 is dislodged from frame 31 and continues its dropping movement in the direction of arrows 92 as a compact sand packet 89 (FIG. 2). Advantageously, the surfaces of lamellae 21 facing the sand are coated with a layer of static friction inhibiting material such as, for example, Teflon. Providing this coating avoids the possibility that the opening lamellae will tear out parts of the sand from the compact sand packet. The inside wall of intermediate container 9 may also be coated with a layer of Teflon or similar material so that the disturbing factor of adhesive friction will be minimized during dislodging.

The conduit formed by the sleeves 59 and 61 leading to box 53 causes the entire body of filling sand 10 to reach the molding box 53 as the body of sand 58 shown in FIG. 2. Thereafter, bracket 62 and sleeve 61 are lifted by reverse operation of piston and cylinder assembly 65, into position 67, and the pattern arrangement 51 with the molding box 53 and the sand filling 58 is pushed away in a conventional manner and is replaced by a new pattern arrangement and molding box for the next filling operation. The opened bottom closure 19 is closed by reverse operation of piston and cylinder 25 to position 29. The intermediate container 9 moves at least once from the position 45 into the position 47 and back, and during this motion the delivery mechanism 5 conveys molding sand 3 from silo 1 with the aid of the centrifugal roll 7 into the intermediate container 9 until the intermediate container is filled with sand 10 to a predetermined degree. An exit slide 2 is movable in height between two positions 4 and 6 to make possible different quantities or flow rates of sand being filled into the intermediate container.

Experiments have shown that the sand packet 89, when passing through vertical lamellae 21, is slowed down only insignificantly. The experiments show, above all, that the distribution of the sand packet 89 into several individual packets while passing through the lamellae does not decrease the compacting effect of the molding sand significantly upon impact on the pattern arrangement 51, so long as the thickness 22 of lamellae 21 is not selected too large and the upper edge is sharpened or beveled in the manner of a blade, as shown in FIG. 4*b*.

Experiments which were made with an arrangement according to FIGS. 1–4 with a drop height of 1.5 meters resulted in a higher compaction of sand filling 58 than that which is achieved by compaction using vibration. It was particularly surprising that, in this case, the weight per unit volume of the sand filling 58 is very uniform and shows no decrease of any significance up to the level 93 at the top of the filling box. If needed, it is, of course, possible to recompact, and this recompacting can be accomplished in a mechanical manner or, alternatively, using explosion or sudden expansion of gases.

When the inside dimensions 55 of the frame 31 are selected smaller than the inside dimensions 57 of the molding box 53, then the air which is to be displaced from the molding box upon insertion of the sand filling 10 therein can not only escape more easily, but the experiments show that the sand filling 58 into the molding box 53 along the inside walls 91 of the molding box will thereby be compacted to the same extent as in the middle part of the mold.

FIG. 4*a* illustrates another embodiment of an intermediate container and those portions of this embodiment will be described insofar as they deviate from the embodiment shown in FIGS. 1–4. Piston and cylinder arrangements 95 are disposed on both sides of the frame in this embodiment, the piston rods 96 extending therefrom being shown in a position 97 which holds the bottom closure 19 in the open position through a rod or linkage system 26. The two levers 99 disposed on both sides, to which lifting rods 101 are articulated, have plastic pipes 103 which carry the frame 31 to the lifted position 107 by contact with brackets 105 connected to the frame 31. When the operation of cylinders 95 is reversed, then the piston rod 96 moves from the position shown to a further extended position in which pivot point 97 moves to the location 109 and closes the bottom closure (position 29, previously described). At the same time, levers 99 are moved so that the pivot point shown in position 111 is moved into the position 113, as a result of which the frame 31 is lowered from the position 107 into the position illustrated by phantom line 115 in which the frame is supported on the upper frame 13 by brackets 105.

The embodiment according to FIG. 4*a* operates as follows.

When the intermediate container 9, filled with sand 10, is in the position 45 and the bottom closure 19 is in the closed position 29, then the frame 31 is in the lowered position 115. The plastic pipes 103 are spaced by the pistons 117 from the truss or bracket members 105 and are unloaded. When the bottom closure 19 is opened by reverse operation of piston and cylinder assemblies 95, then piston rods 96 move so that the ends thereof travel from the position 109 into position 97, and the levers 99 move out of position 113 into position 111 and lift the lifting rods 101 and the plastic pipes 103. Only after the plastic pipes 103 which, when loaded, are deformed elastically, are lifted by pistons 117, then the frame 31 is also lifted suddenly from the position 115 into the position 107, thereby releasing the sand filling 10 (see FIG. 1) from the intermediate container 9. While the embodiment according to FIG. 4 releases the sand filling suddenly at the beginning of the opening process of bottom closure 19, the embodiment according to FIG. 4*a* differs in that the time of the sudden release of the body of sand from the intermediate container 9 can be selected at any arbitrary point in time of the opening process. The selection of the time is made possible by a change of the distance 117 or selection of the length of plastic pipe 103.

FIGS. 5 and 6 show an arrangement which makes it possible to use the techniques in accordance with the invention for particularly large molds. The arrangement as shown in FIGS. 5 and 6 differs from the arrangements according to FIGS. 1–4 and 4*a* in that the intermediate container 9 is subdivided by intermediate walls 119 into four partial containers 9*a* to 9*d*. As a result of this division, the length 121 of each lamellae 21*a* to 21*d*, and the thickness 22 of the lamellae, can be selected within a still permissible thickness for the passage of the sand packet 98 through the lamellae 21.

The construction of the delivery mechanism 5*a* and of the centrifugal roller 7*a*, according to FIGS. 5 and 6, corresponds, apart from the greater width 123, to the embodiment according to FIG. 1.

Intermediate container 9 with the bottom closure 19 is supported by a carrying structure 11 which includes an upper frame 13 and a lower frame 15 interconnected by vertical support members 17. The carrying structure 11 is additionally stifened by narrow supports 125 which also serve as supports for intermediate bearings or journals 127 for the individual lamellae 21*a*–21*d*. The frame 31 is subdivided into four partial spaces 131 by three additional double intermediate walls 129. The double intermediate walls 129 extend on both sides of, and over, the carriers 125 and can be lifted and lowered simultaneously with frame 31 with which they are firmly connected. The operation of bottom closure 19, and of the sudden lifting and lowering of the frame 31 takes place in the same manner as described for FIG. 4*a* through the fact that components like the arrangements 95, 96, 26, 99, 101, 103 and 105 provided on both sides of frame 31 are also provided inside of the double intermediate walls 129.

FIGS. 7–10 show an embodiment which differs basically from the embodiments according to FIGS. 1–6. Whereas the frame 31 in FIGS. 1–6 is made in one part and is movable only vertically, the embodiment according to FIGS. 7–10 includes a structure wherein a bipartite frame or housing 133 is provided which is divided along a diagonal plane 135 into frame halves 133*a* and 133*b* which can be pulled away suddenly, in opposite directions, from the body of sand 136 contained therein, and can then be put back together again. The frame halves 133*a* and 133*b* are supported on the carrying structure 144 by way of flaps or brackets 134*a* and 134*b* which are fixedly attached to the frame halves. In order to release the body of filling sand 136 from frame 133 of the intermediate container 139, cylinders 141 with piston rods 143 are provided, the piston rods being fixedly attached to vertically movable members 145 which are provided at the corners 137 and 139 at which the frame structure is divided. The cylinders 141 are fixedly attached to lower frame 142 of the carrying structure 144. The frame halves 133*a* and 133*b* are provided, respectively, with members 147 and 149 (FIG. 10), which are provided with protruding cams 151 and 153. These cams engage grooves 155 and 157 of the corner members 145. As best seen in FIG. 9, grooves 155 and 157 in member 45 diverge outwardly and downwardly, and cams 151 and 153 are tilted outwardly to mate with those grooves.

FIGS. 9 and 10 show the corner structure with the frame halves in the closed position. When members 145 are lifted from the position illustrated by the solid lines at 161 into the position illustrated by the phantom lines 163 by operation of piston and cylinder assembly 141, after passing through a small partial stroke, the frame halves 133*a* and 133*b* are suddenly and abruptly separated so that the mating surfaces thereof move to the positions 165 and 167 because the cams 151 and 153 are guided, with clearance, in the grooves 155 and 157 outwardly, and the frame halves are pulled away from the contained body of sand. Because the frame halves are pushed apart suddenly, the sand filling 136 drops as a solid sand package 89 (FIG. 2) from the intermediate container 138 formed by the bottom closure and the frame halves. When the parts 145 are again lowered by the reverse operation of piston and cylinder assembly 141 from the position 163 into position 161, then the frame halves are again moved to their closed position.

While certain advantageous embodiments have been chosen to illustrate the invention it will be understood by those skilled in art that various changes and modifications can be made therein without departing from the scope of the invention as defined in the appended claims.

What is claimed is:

1. A process for producing a foundary mold comprising the steps of providing a molding box on a pattern plate for receiving molding sand, providing an intermediate container to receive molding sand from a supply thereof, the intermediate container having an openable bottom closure, precompacting the molding sand in the intermediate container;

locating the intermediate container above the molding box, and abruptly opening the bottom closure of the intermediate container and suddenly releasing the body of sand contained therein so that the body of sand falls as a packet and is deposited in the molding box.

2. A process according to claim 1 and further including dropping the intermediate container onto fixed stops during opening of the bottom closure.

3. A process according to claim 1 and further including the step of suddenly lifting the intermediate container from its resting position during opening of the bottom closure.

4. A process according to claim 1 wherein the intermediate container is a multipart container, and the process includes suddenly pulling the container off of the molding sand.

5. An improved apparatus for producing a foundry mold of the type having a pattern on a pattern plate and a molding box for receiving molding sand around the pattern, the apparatus being of the type having means for loading compact sand into the molding box including a molding sand silo, an intermediate container locatable below the silo and having an openable bottom closure, and drive means for opening and closing the closure, the improvement wherein said intermediate container includes a movable frame; and wherein said apparatus further comprises means for forming a precompacted sand body in said intermediate container; and means for abruptly changing the elevation of said intermediate container during opening of said bottom closure.

6. An apparatus according to claim 5 wherein said means for abruptly changing the elevation includes a carrier frame; and a plurality of roller and lever assemblies for lifting said frame of said intermediate container away from said carrier frame when said closure is closed and for dropping said frame of said intermediate container onto said carrier frame when said closure is opened.

7. An apparatus according to claim 5 wherein said means for abruptly changing the elevation includes a plurality of brackets on said container;

a plurality of elastically deformable pipes for engaging said brackets; and lifting means for lifting said pipes against said brackets and suddenly lifting said container when said closure is opened.

8. An apparatus according to claim 5 wherein said intermediate container comprises a housing formed in two portions separably joined at opposite sides along a plane extending diagonally across the container, cam means protruding outwardly from the housing adjacent the joining plane, and vertically movable means coupled to said can means, said vertically movable means having divergent grooves engaging said cam means for urging said two portions apart when said vertically movable means is lifted relative to said housing.

9. An apparatus according to any of claims 5–8 wherein the horizontal inner dimensions of said intermediate container are smaller than the respective dimensions of said molding box.

10. An apparatus according to any of claims 6–8 wherein said intermediate container comprises wall means for dividing said container into a plurality of compartments, said wall means forming a plurality of slots extending upwardly from the bottom of said container and being fixedly attached to said container frame;

and wherein said carrier frame includes a plurality of narrow supports extending through said slots.

11. An apparatus according to claim 10 wherein said closure includes a plurality of sheet-like lamellae; and journal means for pivotally mounting said lamellae at the bottom of said container for pivotal movement about spaced parallel axes between vertical open positions and horizontal closed positions, a portion of said journal means being mounted in said narrow supports.

12. An apparatus according to claim 5 wherein said closure includes a plurality of sheet-like lamellae; and journal means for pivotally mounting said lamellae at the bottom of said container for pivotal movement about spaced parallel axes between vertical open positions and horizontal closed positions, and wherein the edges of said lamellae which are uppermost in the open position are beveled to a blade-like edge.

13. An apparatus according to claims 5–8 or 12 wherein the inner surfaces of said container are coated with a layer of static friction inhibiting material.

* * * * *